US005571026A

United States Patent [19]

Kahre

[11] Patent Number: 5,571,026

[45] Date of Patent: Nov. 5, 1996

[54] FLAT MOUNT ELECTRODE SOCKET

[75] Inventor: Paul Kahre, Oak Creek, Wis.

[73] Assignee: KCS Industries, Inc., Milwaukee, Wis.

[21] Appl. No.: 352,601

[22] Filed: Dec. 9, 1994

[51] Int. Cl.[6] ..... H01R 33/02

[52] U.S. Cl. ..... 439/242; 439/699.2

[58] Field of Search ..... 439/226, 227, 439/228, 229, 220, 242, 699.1, 699.2

[56] References Cited

U.S. PATENT DOCUMENTS

| | | | |
|---|---|---|---|
| 1,920,710 | 8/1933 | Nelson | 439/242 |
| 1,943,772 | 1/1934 | Prouty | 439/226 |
| 2,071,699 | 2/1937 | Martin | 439/242 |
| 2,296,326 | 9/1942 | Barclay | 439/242 |
| 4,318,158 | 3/1982 | Livermore et al. | 439/699.2 |

*Primary Examiner*—Hien D. Vu
*Attorney, Agent, or Firm*—Foley & Lardner

[57] ABSTRACT

An electrode socket assembly for receiving gas discharge tubes is disclosed. The electrode socket assembly is designed for mounting along a generally flat surface. The assembly includes a barrier panel designed to lie along the flat surface. A housing having a base and a socket is mounted against the barrier panel. A leaf-spring is attached to the base and extends upwardly into the interior of the socket to cooperate with the flexible outer walls of the socket for securely holding the gas discharge tube electrode when inserted into the socket. Additionally, the flexible outer walls of the socket may include ribs that also help secure the gas discharge tube.

17 Claims, 2 Drawing Sheets

FLAT MOUNT ELECTRODE SOCKET

FIELD OF THE INVENTION

The present invention relates generally to an electrode socket assembly that may be mounted along a surface, and particularly to a flat mount electrode socket assembly for gas discharge tubes.

BACKGROUND OF THE INVENTION

Gas discharge tubes, such as those used in neon lighting, are mounted in a variety of environments. For example, many neon lights are used as hanging displays in windows. In this environment, the neon tubes are mounted in the base of the light and ultimately connected to a power source. The neon tubes are typically permanently affixed to a grid, frame, or panel of metal or other material to which a power source is connected. In other applications, the gas discharge tubes are mounted in a base or through a panel that often contains the appropriate circuitry for lighting the gas discharge tube.

Conventional devices may use a socket for receiving the electrode of a gas discharge tube, but such devices rely on gravity or additional supports to hold the tube. Those devices cannot support the discharge tube if the tube is merely inserted into the socket. Thus, the devices become more expensive to manufacture. Additionally, either the tube remains relatively loose within the socket or, if additional support brackets are provided, it becomes difficult to interchange the gas discharge tube.

Therefore, it would be advantageous to provide an economical socket in which a gas discharge tube could easily be inserted and removed. The socket would easily be mounted along a flat surface within a base or along a wall.

SUMMARY OF THE INVENTION

The present invention relates generally to an electrode socket assembly that can be mounted along a surface. The electrode socket assembly is designed to receive and support an electrode of a lighting device, such as a neon lighting tube. The electrode socket assembly may include a barrier panel that is disposed generally along a flat surface, such as a surface within a lighting base or along a wall. The assembly also includes a housing designed for mounting generally along the surface or the barrier panel. The housing includes a base and a socket. The socket has a plurality of flexible panels arranged to grip and support the electrode as it is inserted therein. A spring extends into the socket and is disposed to bias the electrode away from the barrier panel and further support the tube once inserted.

According to other aspects of the invention, the electrode socket assembly includes tabs extending outwardly therefrom to facilitate attachment along a generally flat surface. Additionally, at least some of the flexible panels include ribs designed to help hold the electrode within the socket. The ribs cooperate with the spring, which may be a leaf-type spring attached to the base, to secure the light.

BRIEF DESCRIPTION OF THE DRAWINGS

The invention will hereafter be described with reference to the accompany drawings, wherein like reference numerals denote like elements, and.

DETAILED DESCRIPTION OF THE PREFERRED EMBODIMENT

Figure 1:
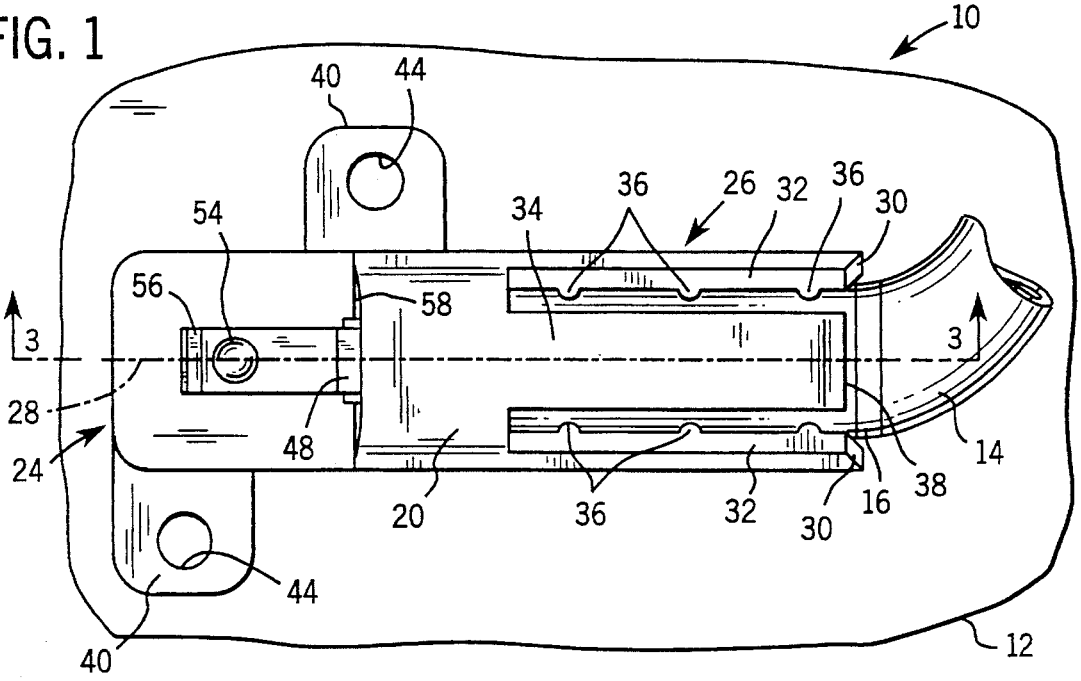
FIG. 1 is a top plan view of an electrode socket assembly according to a preferred form of the present invention.

Referring generally to FIGS. 1–4, an electrode socket assembly 10 is designed for mounting along a surface 12, typically a generally flat surface, and is configured to receive a gas discharge tube 14 typically having an electrode 16. The electrode socket or receptacle assembly includes a barrier panel 18, a housing 20, and a spring 22. Surface 12 is typically a surface of an object disposed within a lighting base, but it could also be an exterior surface of an object such as wall surface.

Housing 20 preferably includes a base 24 and a socket 26 generally aligned along a longitudinal axis 28. Socket 26 includes a plurality of flexible panels 30 generally aligned with longitudinal axis 28. Flexible panels 30 are designed to grip and support gas discharge tube 14, such as a neon gas discharge tube, when it is inserted into socket 26 along longitudinal axis 28.

Flexible panels 30 may be designed in a variety of configurations, but they are preferably arranged in a group of three panels having a pair of side panels 32 and a guide panel 34 disposed generally transversely to side panels 32. Side panels 32 may each include a series of ribs 36 disposed on the inside of side panels 32 towards longitudinal axis 28 and oriented generally perpendicularly to longitudinal axis 28. Guide panel 34 preferably includes a lip 38 disposed on an opposite end of socket 26 from base 24 and arched generally outwardly from longitudinal axis 28 to facilitate insertion of gas discharge tube 14.

Housing 20 further includes at least one tab and preferably a pair of tabs 40 extending outwardly therefrom. Each tab includes a hole 42 through which a fastener 44, such as a screw, may be extended. Tabs 40 maybe staggered from one another in a direction parallel with longitudinal axis 28 to provide greater stability to electrode socket assembly 10 when mounted along flat surface 12. Although tabs 40, base 24, and socket 26 may be fashioned as individual components, it is preferred that these components are integrally molded from an injection moldable plastic material.

Spring 22 can be constructed in a variety of configurations and disposed within housing 20 in numerous locations. However, spring 22 is preferably a leaf-spring attached to a side wall 46 of base 24. Side wall 46 is disposed generally opposite to barrier panel 18 in general proximity to guide panel 34. In this embodiment, spring 22 includes a flat mounting portion 48 having an orifice 50 therethrough. Orifice 50 is aligned with a hole 52 disposed through side wall 46 of base 24. Spring 22 is attached to base 24 via a fastener 54, such as a rivet. Fastener 54 may also be used to securely hold an electrical connector 56 against spring 22. Electrical connector 56 can be used as a connection point for connecting electrode socket assembly 10 to a power source (not shown).

From flat mounting portion 48, spring 22 extends into the interior of socket 26 through a slot 58 disposed between base 24 and socket 26. Generally, spring 22 includes an intermediate portion 60 that extends from flat mounting portion 48 towards barrier panel 18. Spring 22 further includes a bowed portion 62 connected to intermediate portion 60. Bowed portion 62 archs towards guide panel 34 and then back towards barrier panel 18. Thus, as gas discharge tube 14 is inserted into socket 26, it slides between bowed portion 62 and guide panel 34. Spring 22 is thereby flexed towards barrier panel 18 so electrode 16 of gas discharge tube 14 may be securely held between spring 22 and guide panel 34, as well as between side gripping panels 32.

When gas discharge tube 14 is inserted into socket 26, electrode 16 is held in contact with spring 22. Spring 22 is a conductive material, such as a conductive metal, to permit the flow of current from electrical connector 56 to electrode 16 to illuminate gas discharge tube 14. Barrier panel 18 is generally a flat panel that abuts housing 20 on a side generally opposite guide panel 34 of socket 26 and side wall 46 of base 24. Guide panel 18 includes at least one tab and preferably a pair of tabs 64 that are generally aligned with tabs 40 of housing 20. Each tab 64 includes a hole 66 that overlies a corresponding hole 42 of housing tabs 40. Thus, when electrode socket assembly 10 is mounted to surface 12, fasteners 44 may be inserted through holes 42 and 66 to hold the entire assembly against surface 12. Although barrier panel 18 may be made from a variety of materials, it is preferably made from an injection moldable plastic. Both housing 20 and barrier panel 18 may be molded from a material such as GE Lexan 503R glass filled polycarbonate.

Figure 2:
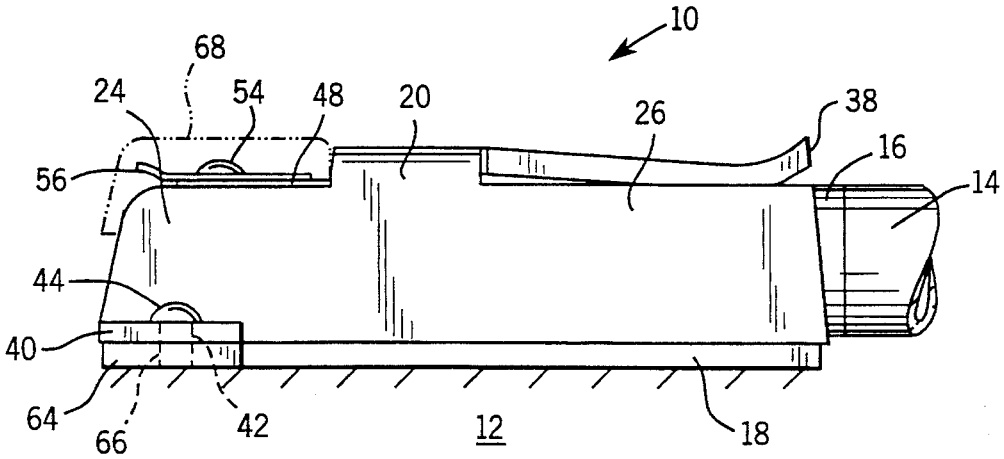
FIG. 2 is a front elevational view of the device shown in FIG. 1.
Figure 3:
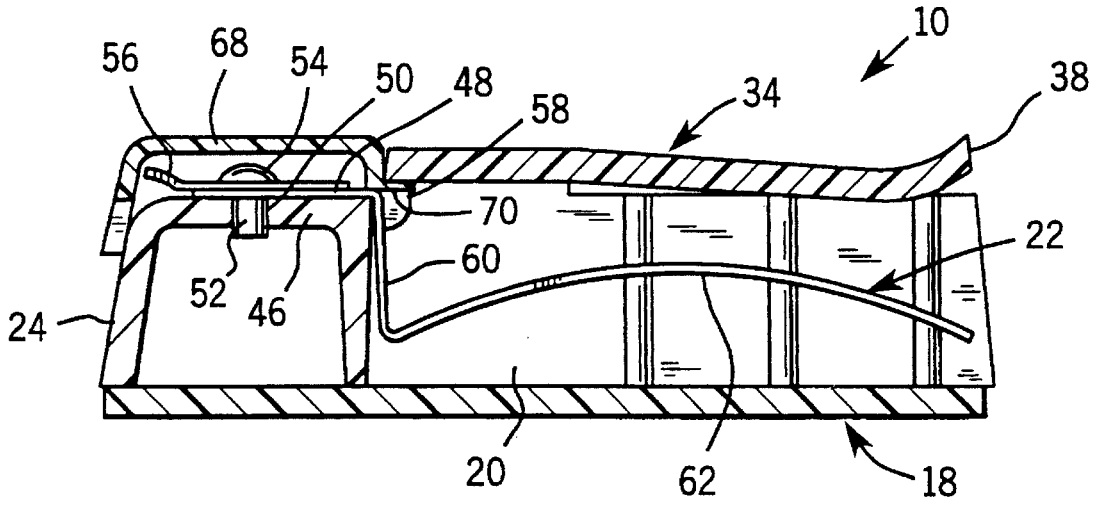
FIG. 3 is a cross-sectional view taken generally along line 3—3 of FIG. 1 wherein the gas discharge tube has been removed.
Figure 4:
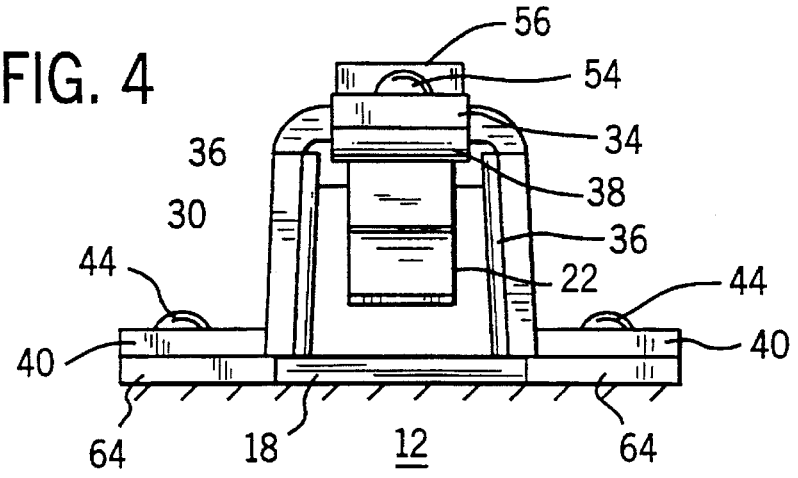
FIG. 4 is an end view of the electrode socket assembly shown in FIG. 1 illustrating the interior of the socket.

Optionally, electrode socket assembly 10 may include a cover 68 attached over side wall 46 of base 24, as shown in phantom in FIG. 2 and in cross-section in FIG. 3. Cover 68 may be attached to base 24 in a variety of ways including pins connected to corresponding holes in base 24, adhesives or snap fits. However, cover 68 preferably includes a tab 70 adapted for insertion into slot 58 to help hold cover 68 in place over base 24.

It will be understood that the foregoing description is of a preferred exemplary embodiment of the invention and that other changes and substitutions are within the scope of the invention. For example, the housing, spring and barrier panel may be made from a variety of materials; the spring may be formed in a variety of configurations and positioned or attached in different locations throughout the housing; lighting devices other than gas discharge tubes can potentially be used with the electrode socket assembly; the barrier panel may be unnecessary in certain applications; and the socket assembly may be mounted along a variety of surfaces within a larger assembly or as a stand-alone fixture along a wall. These and other modifications to the design and arrangement of the components will be apparent to those of ordinary skill in the art.

What is claimed is:

1. An electrode socket assembly that can be mounted along a mounting surface of an object and is designed to receive an electrode of a lighting device, comprising:

a housing having ends including a base at one of the ends and a socket at the other of the ends, the socket including a plurality of flexible panels, the flexible panels being non-conductive and arranged to grip the electrode;

a spring extending into the socket, the spring being disposed to bias the electrode towards at least one of the flexible panels when the electrode is inserted into the socket; and further comprising a barrier panel designed to abut along the base and the socket of the housing when the housing is mounted along the mounting surface, of object.

2. The electrode socket assembly as recited in claim 1, wherein the plurality of flexible panels includes three panels.

3. The electrode socket assembly as recited in claim 2, wherein the panels include a pair of generally opposed gripping side panels and a guide panel disposed generally transversely to the gripping panels.

4. The electrode socket assembly as recited in claim 3, wherein each gripping side panel includes a plurality of ribs disposed to help grip the electrode when inserted into the socket.

5. The electrode socket assembly as recited in claim 3, wherein the barrier panel is disposed generally opposite the guide panel.

6. The electrode socket assembly as recited in claim 5, wherein the guide panel has a curled outer lip to facilitate insertion of the electrode.

7. The electrode socket assembly as recited in claim 1, wherein the spring comprises a conductive material.

8. The electrode socket assembly as recited in claim 7, wherein the spring is a leaf spring having a bowed portion disposed within the socket.

9. An electrode socket assembly that can be mounted along a mounting surface of an object and is designed to receive an electrode of a lighting device, comprising:

a housing including a base and a socket, the socket including a plurality of flexible panels, the flexible panels being non-conductive and arranged to grip the electrode;

a spring extending into the socket towards at least one of the flexible panels when the electrode is inserted into the socket; and a barrier panel designed to abut along the base and the socket of the housing when the housing is mounted along the mounting surface of the object, wherein the barrier panel includes a pair of tabs extending therefrom to facilitate attachment to the mounting surface, each tab including an opening therethrough to receive a fastener, the housing further including a pair of mounting tabs, each mounting tab having an opening overlaying one of the openings in the corresponding barrier panel tab to permit insertion of a fastener therethrough.

10. A gas discharge tube electrode receptacle assembly for receiving an electrode of a gas discharge tube that may be illuminated when energized by a suitable power source, the receptacle, comprising:

a housing having ends including a base at one of the ends and a socket at the other of the ends, and an attachment region to facilitate attachment along a surface of an object, the socket being defined in part by a plurality of flexible panels that can flex and grip the electrode when the electrode is inserted into the socket;

a conductive spring configured for communication with the power source and disposed within the interior of the socket to contact the electrode when the electrode is inserted into the socket; and a barrier panel abutting along the base and socket of the housing when the receptacle assembly is mounted along the surface of the object, wherein the conductive spring extends into the socket to bias the electrode towards at least one of the flexible panels.

11. The electrode socket assembly as recited in claim 10, wherein the spring is integral with the conductor.

12. The electrode socket assembly as recited in claim 10, wherein the plurality of flexible panels includes three panels, the three panels and a portion of the barrier panel defining sides of the socket.

13. The electrode socket assembly as recited in claim 12, wherein the flexible panels include at least two panels each having a plurality of ribs to facilitate gripping of the electrode.

14. The electrode socket assembly as recited in claim 13, wherein the spring is a leaf spring.

15. The electrode socket assembly as recited in claim 12, wherein two flexible panels are ribbed panels each have the plurality of ribs, the two flexible panels being disposed opposite one another, and wherein a third flexible panel is a guide panel disposed generally transversely to the ribbed panels.

16. A gas discharge tube electrode receptacle assembly for receiving an electrode end of a gas discharge tube that may be illuminated when energized by a suitable power source, the receptacle being adapted for mounting along a mounting surface of an object, comprising:

a barrier panel having attachment tabs to facilitate attachment to the mounting surface;

a housing abutting the barrier panel, the housing having mounting tabs disposed to overlie the attachment tabs, the housing including a base portion and a socket portion, the socket portion being defined by a flexible guide panel and a pair of gripping panels disposed generally transversely to the guide panel, the gripping panels each having a plurality of ribs arranged to grip the electrode end, wherein the guide panels, gripping panels, and barrier panel are arranged to receive the electrode end therebetween; and a conducting spring member extending into the socket to contact the electrode end when the electrode end is inserted into the socket portion in a longitudinal direction.

17. The electrode receptacle assembly as recited in claim 16, wherein the conducting spring member extends into the socket to bias the electrode end in a direction generally transverse to its longitudinal direction of insertion.

* * * * *